United States Patent [19]

Sado

[11] 4,289,943

[45] Sep. 15, 1981

[54] PUSH-BUTTON SWITCHES

[75] Inventor: Ryoichi Sado, Saitama, Japan

[73] Assignee: Shin-Etsu Polymer Co., Ltd., Tokyo, Japan

[21] Appl. No.: 173,330

[22] Filed: Jul. 29, 1980

[30] Foreign Application Priority Data

Aug. 6, 1979 [JP] Japan ..... 54-100107

[51] Int. Cl.[3] ..... H01H 13/52

[52] U.S. Cl. ..... 200/159 B; 200/73; 200/160

[58] Field of Search ..... 200/159 B, 160, 67 PK, 200/5 A, 340, 73

[56] References Cited

U.S. PATENT DOCUMENTS

| | | | |
|---|---|---|---|
| 3,016,439 | 1/1962 | Hagberg | 200/160 |
| 3,072,769 | 1/1963 | Roeser | 200/160 |
| 3,932,722 | 1/1976 | Obata et al. | 200/159 B |

*Primary Examiner*—Willis Little

*Attorney, Agent, or Firm*—Hopgood, Calimafde, Kalil, Blaustein & Judlowe

[57] ABSTRACT

Different from conventional push-button switches with which an electric circuit is closed and opened as the button top is pushed with a finger tip and as the finger tip is withdrawn from the button top, respectively, the inventive push-button switch operates in a unique manner that the electric circuit is opened already as the pushing force by the finger tip is still on the way of increasing. The inventive push-button switches utilize the delicate snap back action taking place as the strain in the snap spring portion in the diaphragm covering of the switch exceeds a certain critical point so as to spontaneously pull apart the movable contact member on the inward surface of the covering from the fixed contact points on the base plate while the button top is still under pushing with a finger tip. The inventive push-button switch is advantageous because of the absence of the transient disturbances in the circuit such as chattering and bouncing.

2 Claims, 21 Drawing Figures

PUSH-BUTTON SWITCHES

BACKGROUND OF THE INVENTION

The present invention relates to a novel push-button switch or, more particularly, to a push-button switch with which consecutive signals of switching on and off are spontaneously obtained by a single action of pushing the button.

Many electric and electronic instruments and appliances are provided with one or more of push-button switches either as isolated ones or as a panel of keyboard switches. A variety of structures and principles are utilized for these push-button switches according to need. One of typical structures of such push-button switches is composed of a base plate having a pair of contact points fixedly provided thereon and a dome-like covering facing the contact points made of a diaphragm of a flexible and resilient material having a movable contact member on the inward surface thereof at the top portion of the dome so as that the electric circuit between the fixed contact points on the base plate is closed when the contact member is downwardly depressed with a finger tip or the like from above the top portion of the dome to come into contact with the fixed contact points. When the pushing force on the top portion of the dome is removed, the contact member comes apart from the contact points by virtue of the resilience of the diaphragm material so as to open the electric circuit between the contact points on the base plate.

Push-button switches of such a type are widely employed owing to the simplicity of their structure but they are defective in some aspects including the undesirable transient disturbances of the phenomena of so-called chattering or bouncing. Therefore there have been made various attempts to eliminate the undesirable phenomena from the push-button switches of the type. For example, chattering or bouncing can be reduced when the contact member is made of an electroconductive rubbery material. Unfortunately, none of the hitherto undertaken attempts is perfect so that many instruments with such a push-button switch, e.g. computers, electronic calculators, electric typewriters, cash registers and the like, in which high reliableness in switching is of utmost importance, cannot be free from the problem of erroneous operation by the irregularities in switching caused by the chattering or bouncing of the electric contact, especially, in the moment of releasing of the pushing force on the push-button by lifting the finger tip depending on the very delicate but unreliable movement thereof although the contacting movement of the contact member is more reliable than in the releasing of the pushing force.

SUMMARY OF THE INVENTION

An object of the present invention is therefore to provide a novel and improved push-button switch free from the above described undesirable transient disturbances such as chattering or bouncing in the contacting condition between the contact points on the base plate and the contact member on the inward surface of the dome-like diaphragm of an elastically resilient material.

The principle of the inventive push-button switch is that, although closing of the electric circuit between the contact points is performed by pushing down the button top with a finger tip to bring the contact member into contact with contact points, opening of the electric circuit takes place before release of the finger tip from the button top without depending on the delicate movement of the finger tip by the spontaneous and consecutive upward reversal of the diaphragm strain with snap action.

The push-button switch of the invention having a novel and improved structure comprises (a) a base plate, (b) at least one pair of contact points fixedly provided on the base plate;

(c) a curved diaphragm covering made of an elastically resilient material to cover the contact points on the base plate, a part of which is shaped in a form of a snap spring or a click spring so as that the part moves toward the contact points when a pushing force is applied to the covering but, when the movement toward the contact points exceeds a limit, spontaneously and rapidly snapped back in the reverse direction to come apart from the contact points, and (d) at least one movable contact member provided on or below the inward surface of the covering at the part of the snap spring so as to come into contact with the contact points on the base plate to close the electric circuit therebetween when the covering is pushed toward the contact points.

DETAILED DESCRIPTION OF THE PREFERRED EMBODIMENTS

Figure 1A:
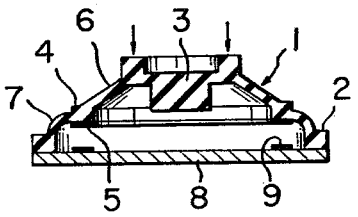
FIG. 1 to FIG. 3 are each an illustration of the deformation of the diaphragm covering of an inventive push-button switch by the cross section.
Figure 1D:
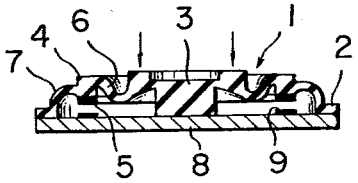
Figure 1B:
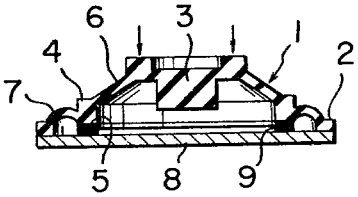
Figure 1D:
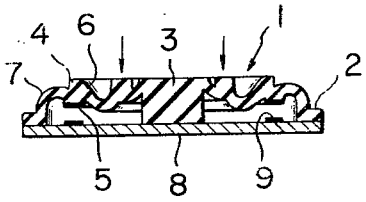
Figure 1C:
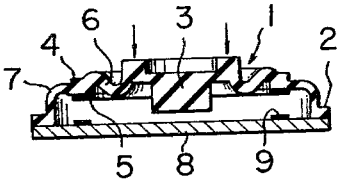
Figure 1E:
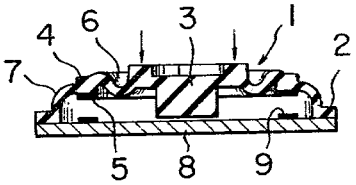

As is described above, the push-button switch of the present invention utilizes the snap spring action of a curved diaphragm made of an elastically resilient material as the incentive for the spontaneous reversal in the movement of the contact member to come apart from the contact points on the base plate even without release of the finger tip from the button top. That is, when the curved diaphragm covering is pushed, for example, at the top center thereof, with a finger tip toward the base plate, the diaphragm covering as a whole moves toward the base plate so as that the contact member provided on the inward surface of the covering at the part of the snap spring comes to contact with the contact points on the base plate to close the electric circuit therebetween while, when the button top is further pushed toward the base plate after the contact member has come to contact with the contact points to produce additional strain beyond a limit, the state of strain of the diaphragm covering is abruptly reversed by the snap spring action of the diaphragm so that the contact member spontaneously comes apart from the contact points to open the electric circuit therebetween.

The above described sequential closing and opening of the electric circuit are performed only during the period of pushing the button top toward the base plate before releasing the finger tip from the push-button so that opening of the electric circuit is obtained by the snap spring action of the diaphragm covering without depending on the delicate and unreliable movement of the finger tip. Therefore, the push-button switch of the invention is completely free from the problem of chattering or bouncing caused by the unreliable releasing of the finger tip.

Moreover, the inventive push-button switch is free from the transient disturbances regardless of how awkwardly the finger tip is removed from the push-button because the contact member has already come apart from the contact points when the pushing force applied to the button top is released so as that the region of the undepressed state of the push-button is always carried out after complete separation of the contact member from the contact points.

Details of the inventive push-button switch are now described in the following.

Firstly, the material for the base plate is conventional and can be any kind of insulating material having rigidity such as thermosetting and thermoplastic polymeric materials so that no detailed explanation is given here. The thickness of the base plate is also not limitative in so far as a degree of rigidity is obtained.

Secondly, the contact points fixedly provided on the base plate are made of an electroconductive material including those solid materials such as metals and electroconductive rubbers and plastics and electroconductive printing inks and paints. It is of course that a push-button switch is provided with at least one pair of the contact points to form an electric circuit to be closed as being contacted with contact member. It is optional that a push-button switch is provided with two pairs or more of the contact points according to need, for example, to ensure increased reliability in the electric connection.

The material for the diaphragm covering is also not limitative in so far as it has a good elastic resilience to ensure reliable snap spring action when the covering is depressed toward the base plate including both electroconductive and electrically insulating materials. Examples of the electroconductive materials are metals and alloys such as phosphor bronze, nickel silver, copper alloys, e.g. beryllium copper, steels, e.g. stainless steel, titanium-containing alloys and the like. Examples of the electrically insulating materials are thermoblastic resins such as polyester, polycarbonates, polyacetals, polyamides, polyurethanes, poly(p-phenylene oxides), polyvinyl chlorides, polyvinylidene chlorides and the like as well as synthetic rubbers such as silicone rubbers, nitrile rubbers, butyl rubbers, isoprene rubbers, urethane rubbers, ethylene-propylene copolymeric rubbers and the like.

The movable contact member, which is provided on or below the inward surface of the diaphragm covering at the part of the snap spring action, is made by shaping an electroconductive plastic or rubbery material containing an electroconductive filler or obtained by printing, transfer or coating with an electroconductive ink or paint to form a conductive coating layer on a substrate or by providing plating with a precious metal on a substrate.

In the following, the structure of the inventive push-button switch is described in further detail by way of examples with reference to the drawing annexed.

FIG. 1 illustrates an embodiment of the inventive push-button switch comprising a rigid insulating base plate 8, a pair of the contact points 9,9 fixedly provided on the base plate 8 and a curved or dome-like diaphragm covering 1 made of an elastically resilient material provided with a ring-wise movable contact member 5 on the inward surface thereof facing the contact points 9,9 on the base plate 8 as is most clearly shown in FIG. 1(*a*) to illustrate the undepressed state of the diaphragm covering 1.

As is illustrated in FIG. 1(*a*), the dome-like diaphragm covering 1 is thick-walled at the conter top 3 protruded downwardly while the lower periphery 2 is flat to be bonded to the base plate 8. The thickness of the diaphragm covering 1 is not uniform in the portion between the center top 3 and the lower periphery 2 but is provided with a ring-wise thick-walled part 4 and two thin-walled parts, also ring-wise, 6 and 7 between the center top 3 and the thick-walled part 4 and between the thick-walled part 4 and the lower periphery 2, respectively. It is essential that the strength of the ring-wise outer thin-walled portion 7 against buckling is smaller than that of the ring-wise inner thin-walled portion 6. On the inward surface of the diaphragm covering 1 at the ring-wise thick-walled part 5 is provided an also ring-wise movable contact member 5 facing the fixed contact points 9,9 on the base plate 8.

When the diaphragm covering 1 is depressed at the center top 3, for example, with a finger tip on the ring-wise raised portion around the center top 3 (shown by the downward arrows), then the diaphragm covering 1 is deformed first at the weakest portion of the outer thin-walled portion 7 as is shown in FIG. 1(*b*) to finally bring the ring-wise movable contact member 5 into contact with the fixed contact points 9,9 on the base plate 8 closing the electric circuit between the contact points 9,9.

When the movable contact member 5 has come to contact with the fixed contact points 9,9 on the base plate 8, the deformation of the ring-wise outer thin-walled part 7 on longer increases beyond the extent at the moment of the contacting between the movable contact member 5 and the fixed contact points 9,9. Therefore, further depression of the center top 3 with the finger tip brings about the deformation of the next weakest portion of the inner thin-walled part 6. When the elastic deformation or strain in this inner thin-walled part 6 has exceeded a critical point, the balance between the strains in the outer thin-walled part 7 and the inner thin-walled part 6 is eventually lost and the thick-walled part 4 is abruptly popped up by the snap spring action of the diaphragm bringing the movable contact member 5 apart from the fixed contact points 9,9 to open the electric circuit therebetween as is shown in FIG. 1(*c*).

Further depression of the center top 3 results in contact of the downward protrusion of the center top 3 with the base plate 8 as is shown in FIG. 1(*d*) but this step is performed with no influences on the state of electric connection since the electric circuit between the fixed contact points 9,9 has been already opened before the downward movement of the center top 3 is interrupted by contacting with the base plate 8.

When the center top 3 is further pushed down at the raised portion shown by the downward arrows after the downward protrusion of the center top 3 has come into contact with the base plate 8, the center top 3 itself is somewhat deformed as is shown in FIG. 1(*d'*) with corresponding deformation of the outer and inner thin-walled parts 6 and 7 showing a state of so-called overstroke.

In the next step, the finger tip pushing the center top 3 downwardly is released as is shown in FIG. 1(*e*) so that the center top 3 is raised back by the elastic resilience of the diaphragm covering 1 to the undepressed state. This step, however, proceeds as a purely mechanical movement of the diaphragm without any electric effect since the electric circuit between the contact points 9,9 has already been disconnected before the finger tip is released. Thus, opening of the electric circuit in the inventive push-button switch can be effected spontaneously without being affected by the delicate and unreliable movement of the finger tip producing no undesirable transient disturbances of chattering or bouncing.

FIG. 2 illustrates another embodiment of the inventive push-button switch by the cross sections each corresponding to a stage in the switching operation from FIG. 2(*a*) to FIG. 2(*e*). The diaphragm covering 11 having a curved cross section as shown in FIG. 2(*a*) is shaped by vacuum forming, pressure forming, compression molding or other suitable techniques with a thin but relatively hard sheet of thermoplastic resin or a metal or alloy having resilience when deformed.

The push-button switch illustrated in FIG. 2 is composed, similarly to that shown in FIG. 1, of a base plate 18, a pair of contact points 19,19 fixedly provided on the base plate 18, a diaphragm covering 11 as mentioned above and a ring-wise movable contact member 15 provided on the inward surface of the diaphragm covering 11 facing the contact points 19,19 on the base plate 18. The diaphragm covering 11 itself has a structure composed of the center top 13 having a concavity at the center, a ring-wise contacting zone 14 on which the contact member 15 is bonded and inner and outer resilient portions 16 and 17, also ring-wise, between the center top 13 and the contacting zone 14 and between the contacting zone 14 and the peripheral flat 12, respectively, and the diaphragm covering 11 is bonded to the base plate 18 at the peripheral flat 12.

The movement of each part of the diaphragm covering 11 in pushing and releasing at the center top 13 is self-evident from FIG. 2(*a*) to FIG. 2(*e*) as well as from analogy to the switch illustrated in FIG. 1. For example, the bending resistance of the inner resilient portion 16 is stronger than that of the outer resilient portion 17 and pushing at the center top 13 first causes the downward bending of the resilient portion 17 so as that the movable contact member 15 is contacted by the contact points 19,19 on the base plate 18 as is illustrated in FIG. 2(*b*) and then abruptly snapped back by the snap spring action caused by the change in the balance of strains between the inner and outer resilient portions 16 and 17 as is shown in FIG. 2(*c*). Further depression and releasing of the center top 13 proceeds with the movable contact member 13 out of contact with the contact points 19,19 as is shown in FIG. 2(*d*) and FIG. 2(*e*) in just the same manner as in FIG. 1(*d*) and FIG. 1(*e*).

FIG. 3 illustrates a somewhat different embodiment of the inventive push-button switch of the invention. In this model, the contact points 29,29 are located near the center of the base plate 28 and the center portion 23 of the diaphragm covering 21, which is bonded to the base plate 28 at the peripheral flat 22, forms the contacting zone provided with the movable contact member 25 bonded on the inward surface thereof. The ring-wise convexity 24 around the contacting zone 23 is the pushing zone at which the diaphragm covering 21 is downwardly depressed evenly by a suitable means as shown by the arrows in FIG. 3(*b*) to FIG. 3(*d*). The inner and the outer ring-wise portions 26 and 27 form the resilient portions and, as the ring-wise pushing zone 24 is downwardly depressed, reversal in the movement of the contacting center zone 23 takes place by the change in the balancing condition of strains between the inner and outer resilient portions 26 and 27 after the movable contact member 25 has been contacted with the contact points 29,29 on the base plate 28 closing the electric circuit between the contact points 29,29. Further depression and releasing of the diaphragm covering 21 at the ring-wise pushing zone 24 are carried out with the movable contact member 25 out of contact with contact points 29,29 so that opening of the electric circuit is carried out without being affected by the condition of releasing in the step illustrated in FIG. 3(*e*). At the moment of complete removal of the pushing force from the pushing zone 24, the raised center portion 23 shown in FIG. 3(*e*) is again reversed down by the snap spring action of the resilient portions 26 and 27 to regain the undepressed state shown in FIG. 3(*a*). In this second reversal of the diaphragm covering 21, the center portion 23 is kept at a sufficient height so that erroneous contacting of the movable contact member 25 and the contact points 29,29 never takes place.

Figure 4:
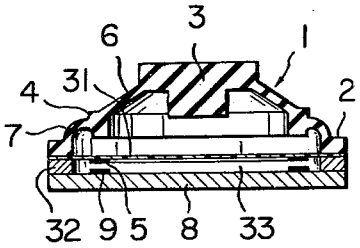
FIG. 4 is a cross sectional view of a modified push-button switch as shown in FIG. 1.
Figure 2A:
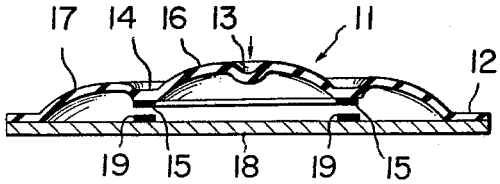
Figure 2B:
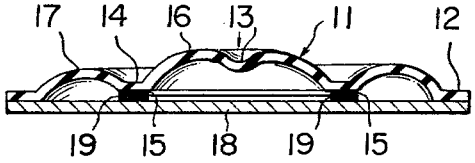
Figure 2C:
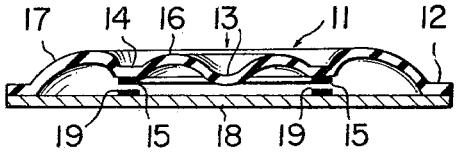
Figure 2D:
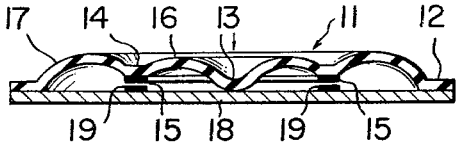
Figure 2E:
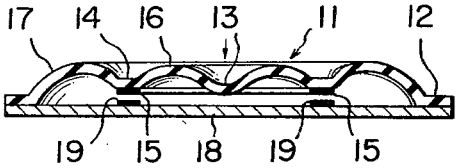
Figure 3A:
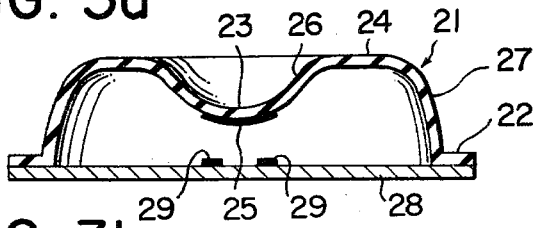
Figure 3B:
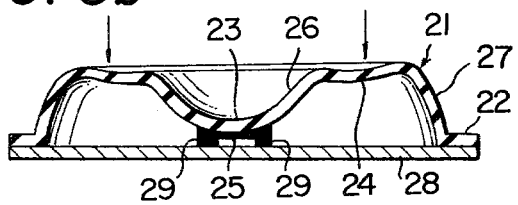
Figure 3C:
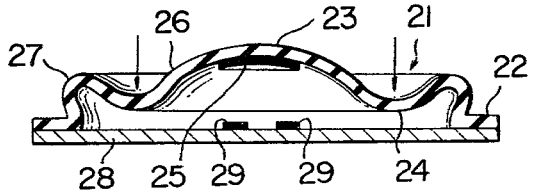
Figure 3D:
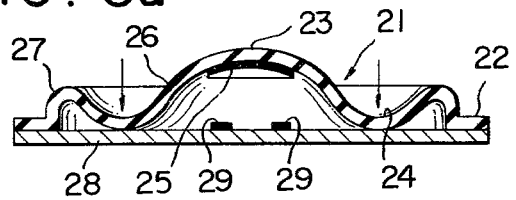
Figure 3E:
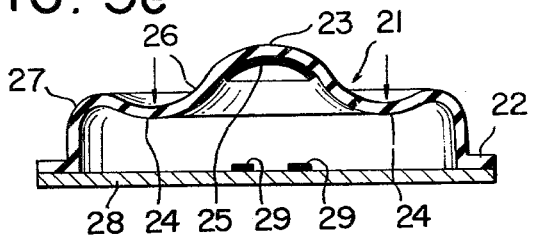

FIG. 4 is a cross sectional view of a further modified push-button switch, in which the diaphragm 1 has just the same configuration as in FIG. 1 except that the ring-wise movable contact member is not provided on the inward surface thereof. Instead, a thin elastic membrane 31 made of, for example, a rubbery material is spanned above the base plate 8 with a suitable tension by means of spacers 32 to form a narrow space 33 therebetween and a ring-wise movable contact member 5 is provided on the downward surface of this thin elastic membrane 31 as confined within the narrow space 33. The downward movement of the movable contact member 5 is effected indirectly through the thin elastic membrane 31 by the movement of the thick-walled part 4 of the diaphragm covering 1 positioned above it.

In contrast to the model shown in FIG. 1 in which the movable contact member 5 is provided on a specific portion of the inward surface of the diaphragm covering 1 having a complicated configuration, the movable contact member 5 in this modified model is provided on a flat surface of the thin elastic membrane 31 so that manufacturing process of the switch is very much simplified, for example, by the techniques of printing with an electroconductive ink or paint which is not applicable to the model of FIG. 1. A further advantage of this modified model is the easiness in decreasing the adverse effects of moisture when the switch is used in a highly humid atmosphere since the movable contact member 5 and the fixed contact points 9,9 are confined in a very narrow space 33 easily protected from moisture.

As is understood from the above description of the typical examples of the invention with reference to FIG. 1 to FIG. 4, it is the most essential point in the inventive push-button switches that the snap spring action takes place while the diaphragm covering is in the state of overstroke and the movement of deformation of the diaphragm covering never follows the same course before and after the reversal of the diaphragm.

Figure 5:
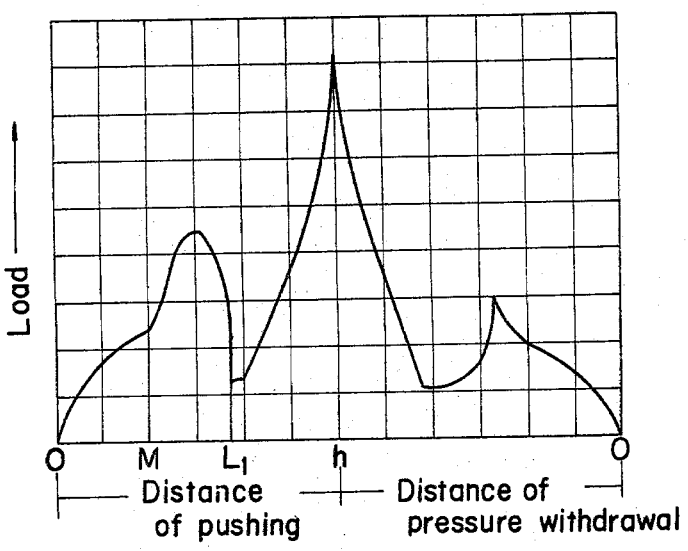
FIG. 5 is a schematic showing of the stroke-load characteristic curve of an inventive push-button switch.

In this connection, the stroke-load characteristic curve shcematically shown in FIG. 5 may be of some help for understanding the behavior of the switches. In FIG. 5, the stroke of the switch is taken as the abscissa and the load is taken as the ordinate. When the stroke is increased starting from the point O at the left end with increasing load, the movable contact member and the contact points on the base plate come to contact with each other at the stroke corresponding to the point M in FIG. 5 and kept in the contacted state until the stroke reaches the point $L_1$ closing the electric circuit. With further increase of the stroke beyond the point $L_1$, reversal of the diaphragm covering suddenly takes place opening the electric circuit between the contacts points and the switch is in the state of overstroke between the points $L_1$ and h, which latter point corresponds to the maximum depression illustrated in FIG. 1(*d*), FIG. 2(*d*) and FIG. 3(*d*). Next the curve between the point h and the right hand point O corresponds to the decreasing stroke and is unsymmetrical with the curve between the lefthand point O and the point h of the maximum depression.

Figure 6:
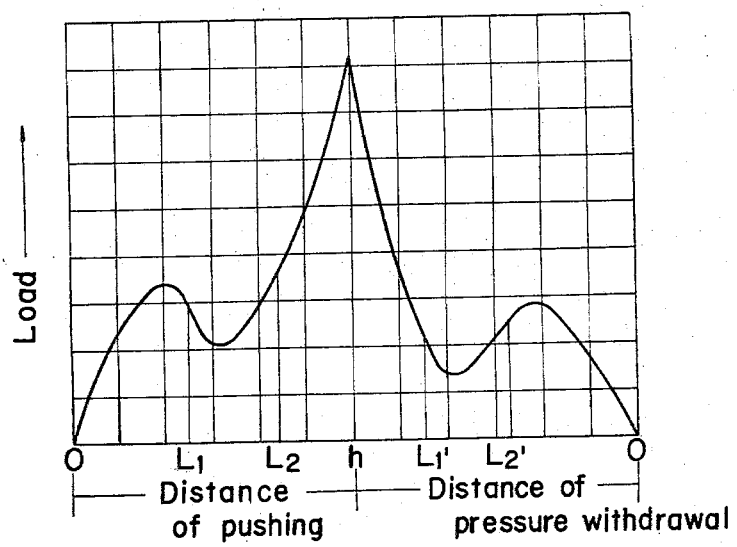
FIG. 6 is a schematic showing of the stroke-load characteristic curve of a conventional push-button switch.

The uniqueness of the above described stroke-load characteristic curve of FIG. 5 is more outstanding when compared with a similar characteristic curve shown in FIG. 6 for a conventional push-button switch. As is clear from this figure, the characteristic curve is approximately symmetrical on both sides of the point h for the maximum stroke and the electric circuit between the contact points is closed in the range from somewhere between the points $L_1$ and $L_2$ and to somewhere between points $L_1'$ and $L_2'$. In other words, opening of the electric circuit always takes place in the stage of decreasing stroke. In the push-button switches of this type, the undesirable transient disturbances of chattering or bouncing are unavoidable due to the mechanical resonating vibration depending on the complicated elastic behavior of the movement of the finger tip, elasticity of the finger tip, elastic properties of the contact points and the movable contact member, elastic properties of the base plate and so on. This phenomenon is not so outstanding in the moment of closing of the electric circuit but frequently causes troubles in the moment of opening of the electric circuit due to the disordered matching between the velocity of finger tip withdrawal and the above mentioned complicated elastic behaviors of the pertaining parts resulting in several times of repeated cycles of contacting and coming apart of the contact points and the movable contact member with appearance of the chattering or bouncing in the electric signals.

On the contrary, withdrawal of the finger tip in the inventive push-button switch is always performed after the electric circuit between the contact points has already been opened so that the uncontrollable phenomenon of mechanical resonating vibration never produces any transient disturbances in the electric circuit.

Needless to say, FIG. 1 to FIG. 4 illustrate only several typical examples of the inventive push-button switches and various modifications are possible within the scope of the present invention. For example, apart from the disc-like models illustrated in the figures by the axial cross sections, the curved diaphragm coverings may be in a form of rectangular or belt-like configuration of a definite width having a transverse cross section similar to those axial cross sections of the disc-like ones illustrated in the figures. In such a design of the curved diaphragm covering, more reliable bonding may sometimes be obtained between the base plate and the diaphragm covering at the peripheral flats thereof.

Further, the pushing zone at which the pushing force is applied to the diaphragm covering is not limited to the center top as is the case in FIG. 1 and FIG. 2 but my be a ring-wise portion surrounding the center as is shown in FIG. 3. The movable contact member is also not limited to a single piece of the form of a ring or disc as illustrated in FIG. 1 and FIG. 2 or FIG. 3, respectively, but may be divided into two or more pieces each for connection a separate pair of the contact points. Further, another movable contact member may be provided on the lower surface of the thick-walled center top 3 in the push-button switch illustrated in FIG. 1 with a corresponding pair of contact points on the base plate 8 so that the switch can operate dually as a combination of an inventive and a conventional push-button switches to produce signals of switching on and off with time delay.

In the following, examples are given to illustrate the present invention in further detail but not to limit the scope of the invention in any way.

EXAMPLE

A push-button switch having a cross section as illustrated in FIG. 1 was prepared. The diaphragm covering 1 is shaped with a silicone rubber compound (KE 951U, a product by ShinEtsu Chemical Co., Japan) with admixture of 2% by weight of a curing agent (C-3, a product by the same company) milled in a mixing roller by compression molding at 170° C. for 10 minutes under a pressure of 10 kg/cm$^2$. The dimensions of the thus shaped diaphragm covering in an undeformed state were as shown in FIG. 7.

Figure 7:
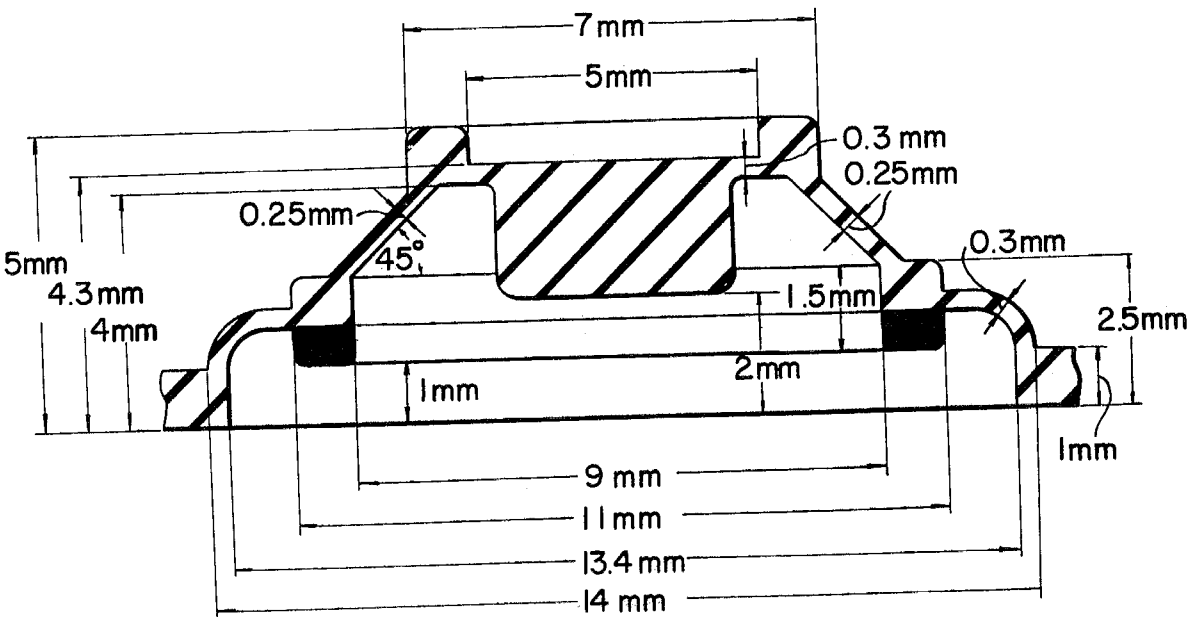
FIG. 7 is a cross section of the diaphragm covering prepared in Example given below.

Further, a ring-wise contact member 5 having dimensions also shown in FIG. 7 was prepared with an electroconductive silicone rubber compound (KE 3601U, a product by the same company) admixed with 4% by weight of a curing agent (C-3) milled in a mixing roller by compression molding at 165° C. for 10 minutes. The diaphragm covering and the ring-like contact member were subjected to post-heating treatment at 200° C. for 4 hours in an air oven.

The ring-like contact member 5 was bonded to the downward surface of the diaphragm covering 1 at the ring-wise thick-walled portion 4 by use of a room temperature-curable silicone rubber compound (KE 42RTV, a product by the same company) and the diaphragm covering 1 was bonded in turn to an insulating base plate 8 with a hole for air escape provided with a pair of contact points 9,9 fixed thereon. The distances from the lower surface of the movable contact member 5 to the surface of the base plate 8 and from the lower surface of the thick-walled center top 3 to the surface of the base plate 8 were about 1 mm and about 2 mm, respectively.

Figure 8:
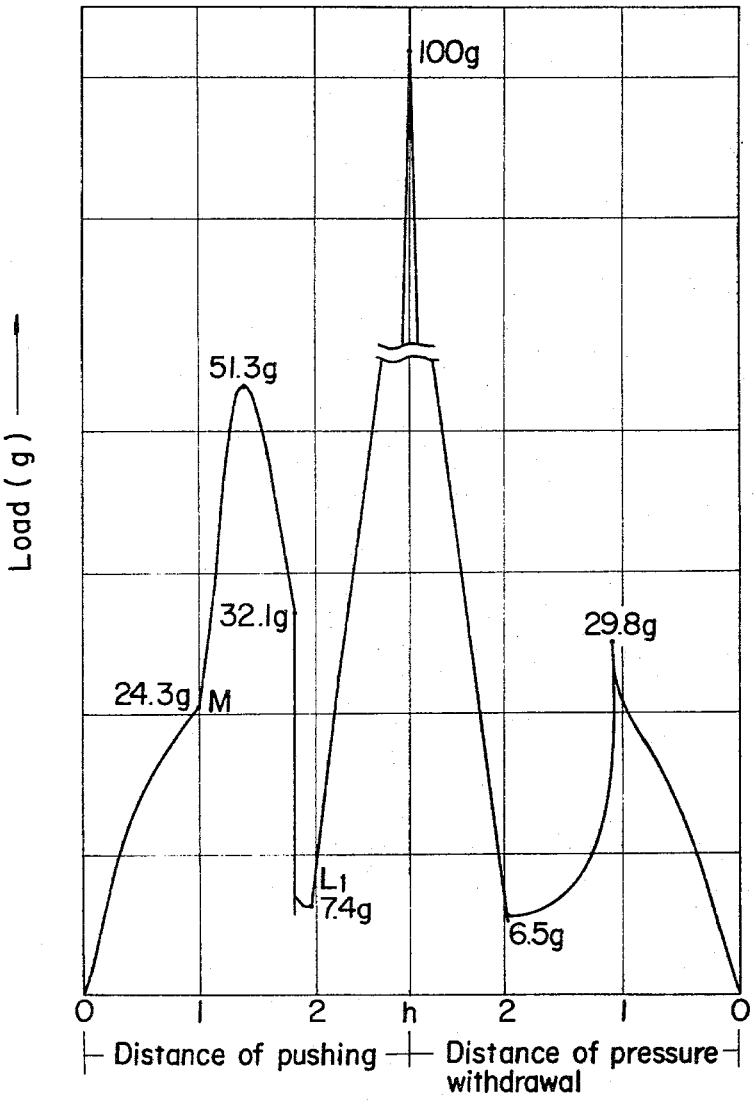
FIG. 8 is an actual stroke-load characteristic curve of a push-button switch prepared in accordance with the invention.

The stroke-load characteristic curve of the above prepared push-button switch was measured by applying a pushing force through a pusher plate mounted on the annular protruded top portion to give the results shown in FIG. 8. No contacting took place in the course of decreasing the load between the movable contact member 5 and the contact points 9,9. The points M, $L_1$ and h in FIG. 8 each correspond to the state illustrated in FIG. 1(*b*), FIG. 1(*c*) and FIG. 1(*d*), respectively.

What is claimed is:

1. A push-button switch which comprises (a) a base plate, (b) at least one pair of contact points fixedly provided on the base plate;

(c) a curved diaphragm covering made of an elastically resilient material to cover the contact points on the base plate, a part of which is shaped in a form of a snap spring or a click spring so as that the part moves toward the contact points when a pushing force is applied to the top of the diaphragm covering but, when the movement toward the contact points exceeds a limit, spontaneously and rapidly snaps back in the reverse direction to come apart from the contact points, and (d) at least one movable contact member provided on the inward surface of the diaphragm covering at the part of the snap spring so as to come into contact with the contact points on the base plate to close the electric circuit therebetween when the diaphragm covering is pushed toward the contact points and to come out of contact with the contact points when the diaphragm covering is snapped back.

2. A push-button switch which comprises (a) a base plate, (b) at least one pair of contact points fixedly provided on the base plate, (c) a dome-like diaphragm covering made of an elastically resilient material composed of (i) an inwardly protruding thick-walled center portion, (ii) an outermost peripheral flat portion at which the dome-like diaphragm covering is bonded to the base plate to cover the contact points, (iii) a ring-like thick-walled portion between the center portion and the peripheral flat, (iv) an inner thin-walled ring-like portion between the center portion and the ring-like thick-walled portion, and (v) an outer thin-walled ring-like portion between the ring-like thick-walled portion and the peripheral flat, and (d) at least one contact member made of an electroconductive material provided on the inward surface of the ring-like thick-walled portion of the dome-like diaphragm covering in such a manner that both of the pair of the contact points on the base plate are contacted therewith when the dome-like diaphragm covering is depressed toward the base plate.

* * * * *